US005577295A

United States Patent [19]

Papke et al.

[11] Patent Number: 5,577,295

[45] Date of Patent: Nov. 26, 1996

[54] THREE DIAMETER HINGE PIN

[75] Inventors: Ronald D. Papke, Shelby Township, Mich.; Chean W. Ng, Richmond Hill; Raymond B. Hawkins, Newmarket, both of Canada

[73] Assignee: Chrysler Corporation, Auburn Hills, Mich.

[21] Appl. No.: 313,623

[22] Filed: Sep. 27, 1994

[51] Int. Cl.[6] ..... E05D 7/10; E05D 5/10

[52] U.S. Cl. ..... 16/254; 16/386

[58] Field of Search ..... 16/254, 262, 263, 16/260, 271, 386, 261, 264

[56] References Cited

U.S. PATENT DOCUMENTS

| | | | |
|---|---|---|---|
| 202,958 | 9/1878 | Patterson | 16/262 |
| 1,429,416 | 9/1922 | Fade | 16/262 |
| 4,542,558 | 9/1985 | Brockhaus | 16/263 |
| 4,573,239 | 3/1986 | Valenti et al. | 16/273 |
| 4,979,263 | 12/1990 | Tolle | 16/262 |

FOREIGN PATENT DOCUMENTS

| | | | |
|---|---|---|---|
| 585849 | 10/1933 | Germany | 16/263 |
| 567342 | 10/1957 | Italy | 16/264 |
| 209585 | 8/1990 | Japan | 16/254 |

*Primary Examiner*—M. Rachuba
*Assistant Examiner*—Donald M. Gurley
*Attorney, Agent, or Firm*—Thomas G. Pasternak

[57] ABSTRACT

A three diameter hinge pin for a vehicle door hinge assembly including a door bracket and a body pillar bracket. The three diameters include successive large upper diameter, small lower diameter, and an intermediate diameter, wherein the latter diameter permits the hinge pin to drop further downwardly through two openings in the upper legs of two hinge brackets, wherein the openings must closely approximate the pin's large upper diameter, thereby allowing the lower end of the pin to enter the opening in the lower legs of the two brackets, rather than being positioned somewhere above the opening.

2 Claims, 2 Drawing Sheets

THREE DIAMETER HINGE PIN

TECHNICAL FIELD

This invention relates generally to a vehicle door hinge assembly and, more particularly, to an improved hinge pin for such a hinge assembly.

BACKGROUND ART

Along an assembly line, after painting of the vehicle body and doors has occurred, typically, each door is removed from the vehicle body after pulling out the hinge pin, so that the usual components can be assembled therein, namely, window glass, the drive mechanism therefor, door lock, outside mirror, and appropriate handles.

Heretofore, difficulties have been encountered in reassembling the completed door on the pillar of the vehicle. Hinge assembly brackets on the respective door and pillar are placed together and aligned so that the hinge pin can be dropped into place through the aligned bracket holes. A relatively tight fit between the holes and the pin is required to prevent a sloppiness in the subsequent opening and closing movements of the door.

Specifically, the pin tends to bind in the upper hinge assembly pair of aligned holes, such that entry of the pin into the lower pair of aligned holes is impeded, requiring tedious and time-consuming manual alignment of the pin with the axis of the aligned bracket holes. Any build-up of paint on the pin from the prior paint spray operation further impedes the alignment and assembly of the hinge pin. The prior art hinge pin for a vehicle hinge assembly has consisted of a large upper diameter and a small lower diameter, wherein the binding occurs around the upper diameter serving to stop the downward progress of the pin toward the lower openings.

Other known prior art hinge pins include Fade U.S. Pat. No. 1,429,416, disclosing a non-rotatable bolt having a square or otherwise formed center segment to cooperate with both a similarly formed aperture in a hinge collar slidably mounted on the lower end of the pin and an opening through an upper hinge lug to prevent rotation of the bolt therein.

Tolle U.S. Pat. No. 4,979,263 discloses a hinge pin having a screw head three successive axially extending portions with decreasing diameters. The middle axial portion is provided with a self-cutting thread for being rigidly but releasably connected to a door-holding rod.

Valenti U.S. Pat. No. 4,573,239 discloses a two-diameter hinge pin. Other known hinge assemblies include single diameter pins.

DISCLOSURE OF THE INVENTION

A general object of the invention is to provide an improved vehicle door hinge assembly.

Another object of the invention is to provide a vehicle door hinge assembly including an improved hinge pin which facilitates the fast and easy assembly of the hinge pin into place in the hinge pin assembly.

A further object of the invention is to provide a vehicle door hinge assembly including a hinge pin having three successive body diameters ranging from a large upper diameter, an intermediate diameter, and a small lower diameter.

Still another object of the invention is to provide a hinge pin for a vehicle door hinge assembly wherein a pin diameter intermediate a large upper diameter and a small lower end diameter permits the pin to drop further downwardly through two openings in the upper legs of two hinge brackets, wherein the openings must closely approximate the pin's large upper diameter, thereby allowing the lower end of the pin to enter the opening in the lower legs of the two brackets, rather than being positioned somewhere above the opening.

These and other objects and advantages will become more apparent when reference is made to the following drawings and accompanying description.

BEST MODE OF CARRYING OUT THE INVENTION

Figure 1:
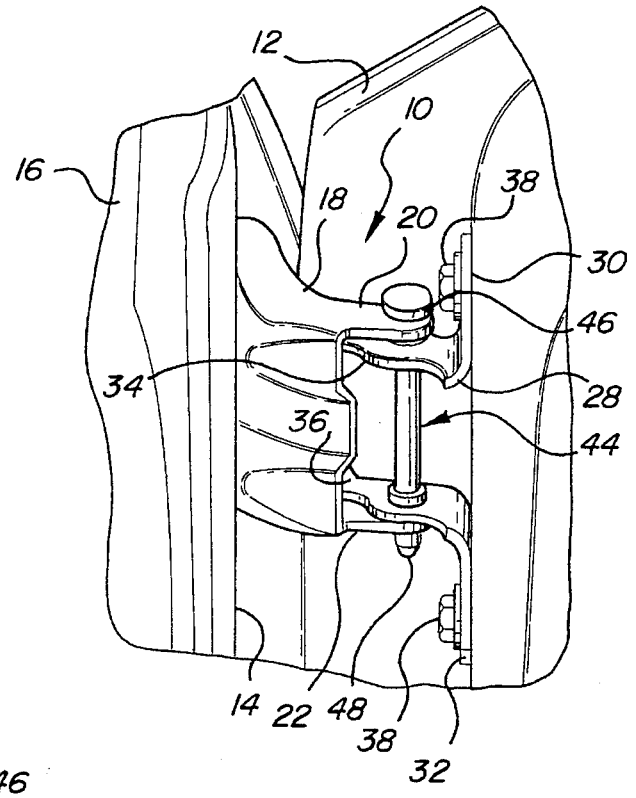
(PRIOR ART) FIG. 1
FIG. 1 is a fragmentary perspective view of a vehicle body and door embodying a hinge assembly of the prior-art.
Figure 2:
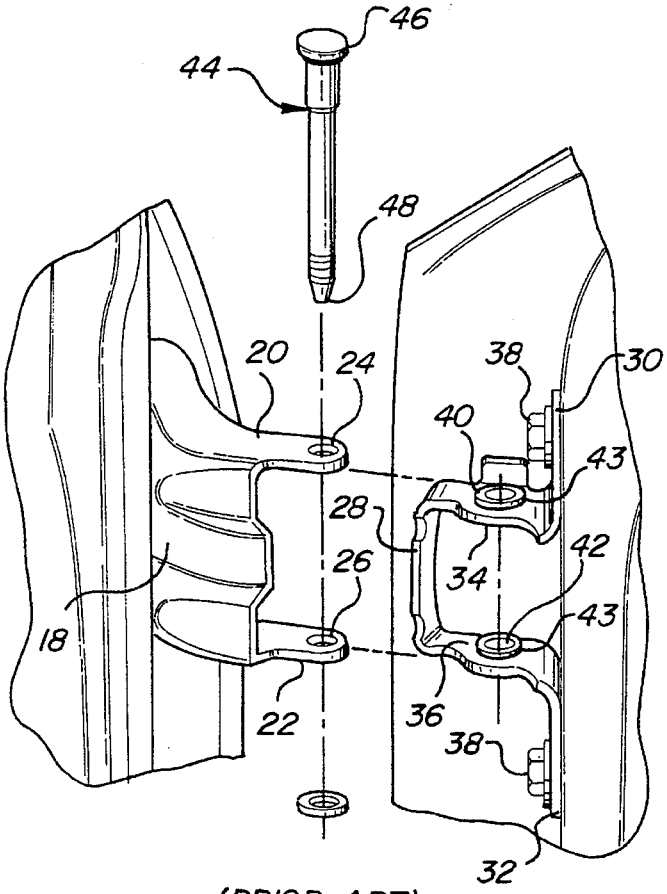
(PRIOR ART) FIG. 2
FIG. 2 is an exploded view of the components of the FIG. 1 structure.

Referring now to the drawings in greater detail, FIG. 1 and 2 illustrate a conventional vehicle door hinge assembly 10 operatively interconnecting a door 12 to a pillar 14 of a vehicle body 16.

The hinge assembly 10 includes a first bracket 18 secured by bolts (not shown) to the pillar 14. Upper and lower legs 20 and 22, respectively, extend outwardly from the bracket 18. Vertically aligned holes 24 and 26 (FIG. 2) are formed in the respective legs 20 and 22.

The hinge assembly 10 further includes a second bracket 28, which is U-shaped with planar perforated mounting flanges 30 and 32 formed on the ends of respective legs 34 and 36. The perforated flanges 30 and 32 are secured to an edge of the door 12 by bolts 38. Vertically aligned holes 40 and 42 (FIG. 2) are formed through the respective upper and lower legs 34 and 36. Suitable bushings 43 may be mounted in the holes 40 and 42.

The spacing apart of the respective pairs of legs 20/22 and 34/36 is such that the latter legs mount inside the former legs, upon the mounting of the door 12 on the pillar 14. The locations of the pairs of holes 24/26 and 40/42 are such that all four are substantially aligned during the door mounting process.

Figure 2A:
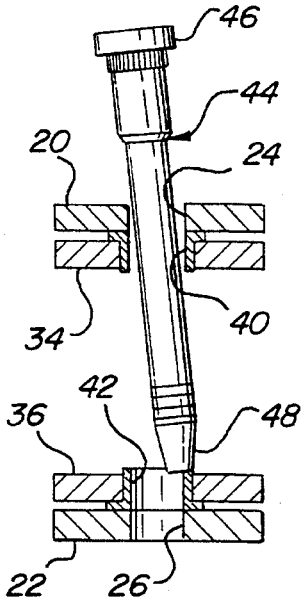
(PRIOR ART) FIG. 2A
FIG. 2A is a cross-sectional view of the legs of a hinge assembly, with the prior art hinge pin in a condition of being assembled.

A hinge pin 44 extends downwardly through the holes 24, 40, 26, and 42 to maintain a pivotal relatively tight fitting relationship between the door 12 and the vehicle body 16. The pin 44 shown in FIGS. 1, 2 and 2A is typically a two-diameter pin with a flanged head 46 and a tapered and blunt lower end 48 for piloting through the holes.

However, as indicated above, at assembly of the vehicle along an assembly line, doors 12 are typically removed from the vehicle bodies 16 after the doors and bodies have been painted, in order to facilitate the loading of the doors with the usual door components, such as windows, window drive mechanisms, locks, handles, and inner door covers. Some difficulty has been experienced in being able to quickly and easily re-assemble the door on the pillar, for the insertion of the hinge pin 44, in keeping up with high production vehicle assembly requirements. Specifically, the pin is inclined to assume an angle in the upper holes 24 and 40 (FIG. 2A), such that the tapered end 48 is positioned outside the edge of the hole 42, making insertion therein a difficult manipulation. The positioning of the end 48 is worsened by the addition of any paint spray which may have built up on the pin during the painting operation.

Accordingly, an improved hinge pin 50 is illustrated in FIGS. 3–6. The pin 50 includes the usual flanged head 52, with a tapered and rounded lower end 54 and a three-diameter body 56*a*, 56*b* and 56*c*, namely, largest, intermediate, and smallest diameters, respectively, of predetermined respective lengths.

A knurled portion 58 may be formed on the body diameter 56*a* adjacent the head 52. An annular groove 60 is formed around the body diameter 56*c* adjacent the tapered end 54, adapted to receive a C-ring 62 (FIG. 6) after assembly, as shown in FIG. 6.

Due to the inclusion of the intermediate body diameter 56*b* of a predetermined length, during any reassembly of the door 12 on the pillar 14, regardless of any paint spray along the length of the intermediate diameter 56*b*, the pin 50 readily drops through the upper two holes 24 and 40 to a point where the tapered end 54 extends below the upper edge of the hole 42. This eliminates any subsequent difficulty with attempting to pilot the end 54 into the hole 42, prior to the final forcing of the pin by an appropriate tool through the holes to the condition shown in FIG. 4.

Figure 3:
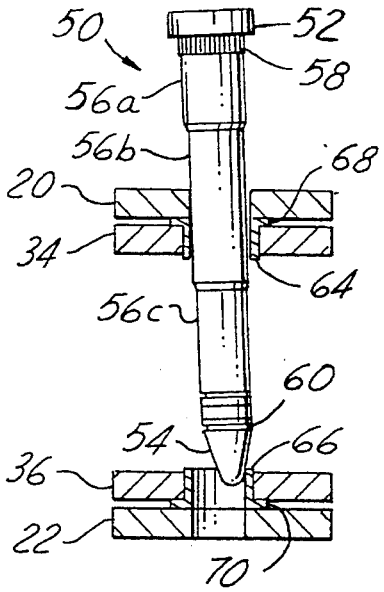
FIG. 3 is a cross-sectional view of the legs of a hinge assembly, with the inventive hinge pin in a condition of being assembled.
Figure 4:
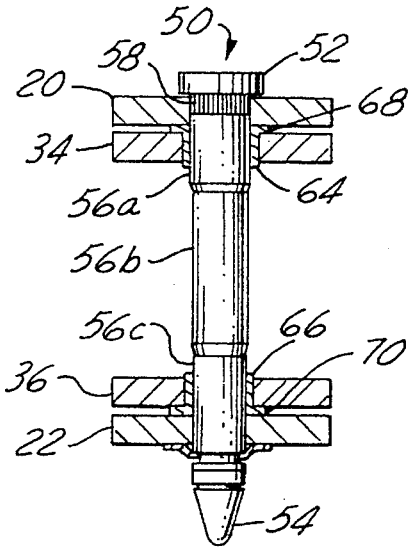
FIG. 4 is a view similar to FIG. 3, with the inventive hinge pin in its fully assembled condition.
Figure 5:
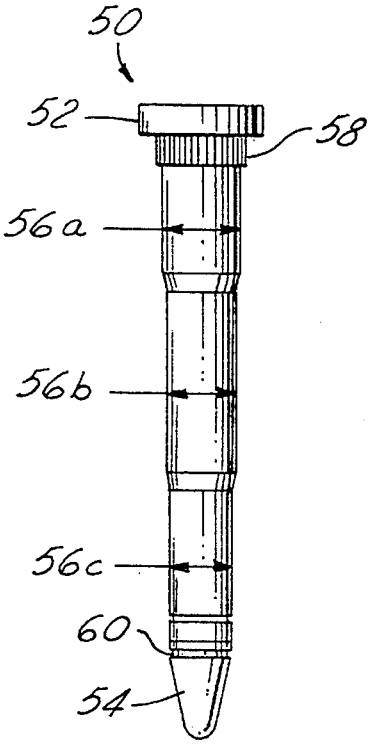
FIG. 5 is an enlarged side elevational view of the inventive hinge pin.
Figure 6:
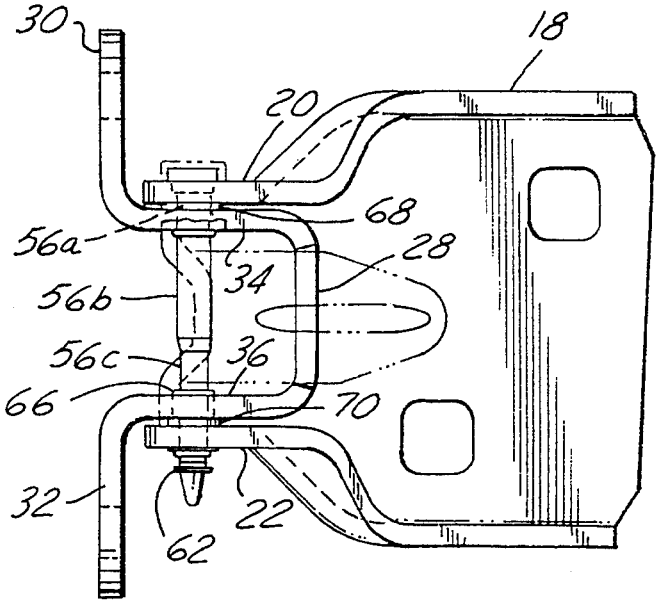
FIG. 6 is a side elevational view of the assembled hinge pin assembly.

As shown in FIGS. 3, 4 and 6, suitable upper and lower bushings 64 and 66, with respective flanges 68 and 70, may be mounted in the holes 40 and 42, with the flanges 68 and 70 mounted between the respective pairs of legs 20/34 and 36/22 of the hinge brackets 18 and 28. To accommodate the bushings 64 and 66, the holes 40 and 42 are formed slightly larger than the holes 24 and 26, so that the inside diameters of the latter holes 24 and 26 and the bushings 64 and 66 are the same.

It is important that the inside diameters of the hole 24 and the upper bushing 64 be a tight pivotable fit, but not a press-fit around the upper body diameter 56*a*, and that the inside diameters of the lower bushing 66 and the hole 42 also be a tight pivotable fit but not a press-fit around the lower body diameter 56*c*, so that there is no sloppiness between the door and the vehicle body during a lifetime of opening and closing the doors of the vehicle. As such, the intermediate body diameter 56*b* is an important feature in the above described assembly process.

INDUSTRIAL APPLICABILITY

It should be apparent that the invention provides an improved vehicle door hinge assembly which facilitates quick and easy assembly of the door on a vehicle pillar.

It should be further apparent that the inventive hinge pin of the improved hinge assembly eliminates problems due to binding or jamming of the pin at assembly, and any increased pin diameter to a build-up of paint spray thereon.

While but one embodiment of the invention has been shown and described, other modifications thereof are possible within the scope of the following claims.

What is claimed is:

1. In a vehicle door hinge assembly including a hinge bracket mounted on each of a door and a vehicle pillar, with each bracket having a pair of upper and lower legs with a space therebetween adjacent the upper and lower spaced-apart legs of the other bracket, and aligned holes formed through the two pairs of legs, the improvement comprising a hinge pin extending downwardly through the aligned holes, the pin including a flanged head, three successive circular body portions of different diameters, and a tapered end, with the largest diameter body portion adjacent the flanged head and mounted in the upper legs with a close tolerance, the smallest diameter body portion adjacent the tapered end and mounted in the holes of the lower legs, and the intermediate diameter body portion located in said space.

2. In a vehicle door hinge assembly including a hinge bracket mounted on each of a door and a vehicle pillar, with each bracket having a pair of spaced-apart legs adjacent the spaced-apart legs of the other bracket, and aligned holes formed through the two pairs of legs, the improvement comprising a hinge pin having a flanged head, three successive axially extending circular portions with upper, middle, and lower circular portions having progressively decreasing diameters from the upper portion, and a tapered distal end, the middle circular portion having a length long enough and a diameter small enough to freely slide through the aligned holes of the respective upper bracket legs such that, upon being dropped through the upper aligned holes, the tapered distal end of the pin begins to enter the aligned holes of the respective lower bracket legs before the upper circular portion enters the upper aligned holes, permitting fast and easy final assembly of the hinge pin therein.

* * * * *

UNITED STATES PATENT AND TRADEMARK OFFICE

CERTIFICATE OF CORRECTION

PATENT NO : 5,577,295

DATED : November 26, 1996

INVENTOR(S) : Papke et al.

It is certified that error appears in the above-identified patent and that said Letters Patent are hereby corrected as shown below:

In the Assignee Section, please add "Multimatic, Inc, Ontario, Canada" as an additional assignee.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*